US007370485B2

(12) United States Patent
Shin et al.

(10) Patent No.: US 7,370,485 B2
(45) Date of Patent: May 13, 2008

(54) PERFORMANCE TESTING APPARATUS OF REFRIGERATING CYCLE

(75) Inventors: Jong Jin Shin, Suwon-Si (KR); Chang Hui Lee, Suwon-Si (KR)

(73) Assignee: Samsung Electronics Co., Ltd., Suwon (KR)

( * ) Notice: Subject to any disclaimer, the term of this patent is extended or adjusted under 35 U.S.C. 154(b) by 534 days.

(21) Appl. No.: 11/029,455

(22) Filed: Jan. 6, 2005

(65) Prior Publication Data

US 2005/0155359 A1 Jul. 21, 2005

(30) Foreign Application Priority Data

Jan. 16, 2004 (KR) ..... 10-2004-0003348

(51) Int. Cl.
*F25B 49/00* (2006.01)

(52) U.S. Cl. ..... 62/125; 62/127; 62/129

(58) Field of Classification Search ..... 62/125, 62/127, 129, 238.1, 238.4, 126, 128, 130, 62/131; 340/585
See application file for complete search history.

(56) References Cited

U.S. PATENT DOCUMENTS

| | | | | |
|---|---|---|---|---|
| 4,301,662 | A * | 11/1981 | Whitnah | 62/238.4 |
| 4,321,801 | A * | 3/1982 | Collard, Jr. | 62/238.4 |
| 5,226,472 | A * | 7/1993 | Benevelli et al. | 165/263 |
| 5,539,382 | A * | 7/1996 | Duff et al. | 340/585 |
| 5,539,385 | A * | 7/1996 | Duff et al. | 340/626 |
| 5,669,234 | A * | 9/1997 | Houser et al. | 62/612 |
| 5,677,677 | A * | 10/1997 | Duff et al. | 340/585 |
| 6,272,868 | B1 * | 8/2001 | Grabon et al. | 62/125 |
| 6,666,040 | B1 * | 12/2003 | Groenewold et al. | 62/173 |
| 6,973,410 | B2 * | 12/2005 | Seigel | 702/182 |

FOREIGN PATENT DOCUMENTS

| | | | |
|---|---|---|---|
| JP | 2-233952 | A | 9/1990 |
| JP | 7-293972 | A | 11/1995 |
| KR | 10-0203843 | B1 | 3/1999 |
| KR | 10-0204529 | B1 | 3/1999 |
| KR | 10-0204818 | B1 | 3/1999 |
| KR | 1999-0041731 | U | 12/1999 |
| KR | 2000-0056441 | A | 9/2000 |
| KR | 2002-0083240 | A | 11/2002 |
| KR | 2002-0091876 | A | 12/2002 |

* cited by examiner

*Primary Examiner*—Frantz Jules
*Assistant Examiner*—Huseyin Koca
(74) *Attorney, Agent, or Firm*—Sughrue Mion, PLLC

(57) ABSTRACT

A performance testing apparatus includes a refrigerant pipe provided with open ends, and installed such that a condenser, an expansion device and an evaporator are sequentially aligned from one end thereof to the other end thereof. A refrigerant heating unit is installed at one end of the refrigerant pipe for heating a refrigerant by a double boiler method and transmitting the heated refrigerant to the other end of the refrigerant pipe. Cooling fluids are respectively provided outside of the condenser and the evaporator for exchanging heat with the refrigerants in the condenser and the evaporator. A flow rate measurement unit is used for measuring the flow rate of the refrigerant flowing within the refrigerant pipe. A temperature and pressure measurement unit measure variations in temperature and pressure of the refrigerant passing through the condenser, the expansion device and the evaporator.

21 Claims, 1 Drawing Sheet

PERFORMANCE TESTING APPARATUS OF REFRIGERATING CYCLE

CROSS-REFERENCE TO RELATED APPLICATION

This application claims the benefit of Korean Patent Application No. 2004-3348, filed Jan. 16, 2004, in the Korean Intellectual Property Office, the disclosure of which is incorporated herein by reference.

BACKGROUND OF THE INVENTION

1. Field of the Invention

Apparatuses consistent with the present invention relate to a performance testing apparatus of a refrigerating cycle for testing a heat exchanger, and, more particularly, to an apparatus for testing a refrigerating cycle of a small capacity heat exchanger.

2. Description of the Related Art

Generally, a refrigerating cycle used by an air conditioner or a refrigerator comprises a compressor, a heat exchanger including a condenser and an evaporator, and an expansion device including an orifice. Such components of the refrigerating cycle form a closed circuit through a refrigerant pipe.

The compressor compresses a refrigerant into a high-temperature and high-pressure gaseous state, and the condenser then condenses the refrigerant into a high-temperature and high-pressure liquid state. Further, the expansion device expands the refrigerant, while in the high-temperature and high-pressure liquid state, into a low-temperature and low-pressure liquid state through a throttling expansion action. The evaporator evaporates the refrigerant in the low-temperature and low-pressure liquid state after being transmitted by the expansion device.

Accordingly, the refrigerant circulating within the refrigerant pipe is condensed by the condenser to emit heat to the surrounding circumference, and is evaporated by the evaporator to absorb heat from the surrounding circumference, thereby being cooled by the evaporator.

Before the above components constituting the refrigerating cycle are installed in the air conditioner or the refrigerator, their performances are measured to test whether or not they are working properly.

A conventional apparatus for testing the heat exchanger and the expansion device includes a general compressor, a refrigerant pipe connected to the compressor and installed such that a condenser, an evaporator and an expansion device. Further, such a testing apparatus includes cooling fluids respectively provided outside of the condenser and the evaporator for heat-exchanging with refrigerants in the condenser and the evaporator. Sensors are respectively installed along the refrigerant pipe at inlets and outlets of the condenser, the evaporator and the expansion device for sensing the temperature and pressure of the refrigerant.

When the compressor is operated under the above-described condition, the refrigerant compressed by the compressor sequentially passes through the condenser, the expansion device, and the evaporator, thus being circulated within the above components. The refrigerant passing through the condenser and the evaporator exchanges heat with a corresponding one of the cooling fluids outside of the condenser and the evaporator. The condenser, the evaporator and the expansion device are tested by measuring variations in the temperatures and pressures of the refrigerant at the inlets and the outlets of the condenser, the evaporator and the expansion device, and measuring a flow rate of the refrigerant flowing within the refrigerant pipe.

Since the refrigerating cycle used in the conventional air conditioner or refrigerator has a capacity of at least several kilowatts (kw), the apparatus for testing components constituting the above-described refrigerating cycle is suitable for testing a heat exchanger and an expansion device employed in such a refrigerant cycle having a capacity of several kilowatts (kw), and where the compressor of the testing apparatus compresses a large quantity of the refrigerant at once based on the capacity of the refrigerant cycle.

Recently, a refrigerating cycle having a capacity of several watts (w), which employs a small capacity heat exchanger and a micro orifice serving as an expansion device, has been developed. Since ultra small capacity compressors have been recently developed, it is expected that such a refrigerating cycle having a capacity of several watts (w), as opposed to the conventional refrigerating cycles having several kilowatts (kw), will be rapidly developed. Accordingly, there is a need for an apparatus for testing the performance of a small capacity heat exchanger and an expansion device, such as a micro orifice, employing the above-noted refrigerating cycle having such a small capacity.

SUMMARY OF THE INVENTION

Therefore, an aspect of the invention is to provide a testing apparatus of a refrigerating cycle, which efficiently tests the performance of a small capacity heat exchanger and a micro orifice employed by a refrigerating cycle having a small capacity.

In accordance with one aspect, the present invention provides an apparatus for testing a refrigerating cycle of a condenser, an expansion device and an evaporator. In particular, a refrigerant pipe is provided with open ends, and is installed such that the condenser, the expansion device and the evaporator are sequentially aligned or disposed from one end thereof to the other end thereof. A refrigerant heating unit is installed at one end of the refrigerant pipe for heating a refrigerant by a double boiler method and transmitting the heated refrigerant to the other end of the refrigerant pipe. Cooling fluids are respectively provided outside of the condenser and the evaporator for exchanging heat with the refrigerants in the condenser and the evaporator. A flow rate measurement unit measures the flow rate of the refrigerant flowing within the refrigerant pipe; and a temperature and pressure measurement unit is provided for measuring variations in temperature and pressure of the refrigerant passing through the condenser, the expansion device and the evaporator.

It is contemplated that the expansion device may include a micro orifice, and at least one filter for eliminating impurities from the refrigerant to prevent the micro orifice from being clogged. The filter may be installed on the refrigerant pipe between the refrigerant heating unit and the micro orifice. The at least one filter may include: a first filter positioned between the condenser and the micro orifice; and a second filter positioned between the refrigerant heating unit and the condenser. Further, the first filter may eliminate from the refrigerant impurities having sizes smaller than those of impurities eliminated by the second filter.

It is further contemplated that a first heater is provided for heating the refrigerant by a double boiler method so as to control the temperature and pressure of the refrigerant transmitted to the condenser to satisfy predetermined requirements at an inlet of the condenser. The first heater may be installed on the refrigerant pipe between the refrigerant heating unit and the condenser. Also, the expansion device may include a micro orifice, and a first pressure regulation valve for controlling temperature and pressure of the refrigerant transmitted to the evaporator to satisfy predetermined requirements at an inlet of the evaporator. The first pressure regulation valve may be installed on the refrigerant pipe between the micro orifice and the evaporator.

The refrigerant heating unit may include a refrigerant tank connected to one end of the refrigerant pipe for containing the refrigerant therein, a water tank surrounding the refrigerant tank for containing water therein, and an electric heater installed outside of the water tank for heating the water in the water tank. Further, the refrigerant heating unit may control the temperature of the refrigerant through a PID controller. Also, an injection port for injecting the refrigerant into the refrigerant tank therethrough may be formed through one side of the refrigerant tank.

The first heater may include a water tank surrounding the refrigerant pipe for containing water, and an electric heater installed outside of the water tank for heating the water tank. Further, the first heater may control the temperature of the refrigerant through a PID controller.

It is additionally contemplated that the temperature and pressure measurement unit may include temperature sensors and pressure sensors respectively installed on the refrigerant pipe at inlets and outlets of the condenser, the micro orifice and the evaporator. The temperature and pressure measurement unit may further include a temperature measurement unit for sensing variation in temperatures of the cooling fluids.

The flow rate measurement unit may include: a refrigerant flow meter installed in the refrigerant pipe at the end of the refrigerant pipe opposite to the refrigerant heating unit. It is further contemplated that a second heater and a second pressure regulation valve are installed on the refrigerant pipe between the refrigerant flow meter and the evaporator for controlling the temperature and pressure of the refrigerant transmitted to the refrigerant flow meter to satisfy predetermined requirements of the refrigerant flow meter.

The second heater may include a water tank surrounding the refrigerant pipe for containing water, and an electric heater installed outside of the water tank for heating the water tank, and may serve to heat the refrigerant by the double boiler method. Further, the second heater may control the temperature of the refrigerant through a PID controller.

A relief valve may be installed in the refrigerant pipe, and serve to discharge the refrigerant from the refrigerant pipe to the outside in case the pressure of the refrigerant is more than a predetermined value.

The condenser, the expansion device and the evaporator may constitute a refrigerating cycle having a capacity of several watts (w). Also, the flow rate of the refrigerant flowing within the refrigerant pipe may be less than several grams (g) per minute. Further, the diameter of the micro orifice may be less than several tens of micrometers (μm).

It is also contemplated that the invention provides means for heating refrigerant by a double boiler method and transmitting the heated refrigerant to an end of a refrigerant pipe; means for exchanging heat with a refrigerant in a condenser and an evaporator; and means for measuring a flow rate of the refrigerant flowing within the refrigerant pipe. Also included is means for measuring variations in temperature and pressure of the refrigerant passing through the condenser, an expansion device and the evaporator.

It is also contemplated that an additional means is provided for heating the refrigerant by a double boiler method to control the temperature and pressure of the refrigerant transmitted to the condenser so as to satisfy predetermined requirements at an inlet of the condenser. Further included is means for controlling temperature and pressure of the refrigerant transmitted to the evaporator so as to satisfy predetermined requirements at an inlet of the evaporator and means for sensing variation in temperatures of the cooling fluids while in the condenser and evaporator. Means may also be included for controlling the temperature and pressure of the refrigerant transmitted to the means for measuring the flow rate, to satisfy predetermined requirements thereof.

BRIEF DESCRIPTION OF THE DRAWINGS

The above aspects, and other features and advantages of the present invention will become more apparent after reading the following detailed description when taken in conjunction with the drawings, in which.

DETAILED DESCRIPTION OF ILLUSTRATIVE, NON-LIMITING EMBODIMENTS OF THE INVENTION

Figure 1:
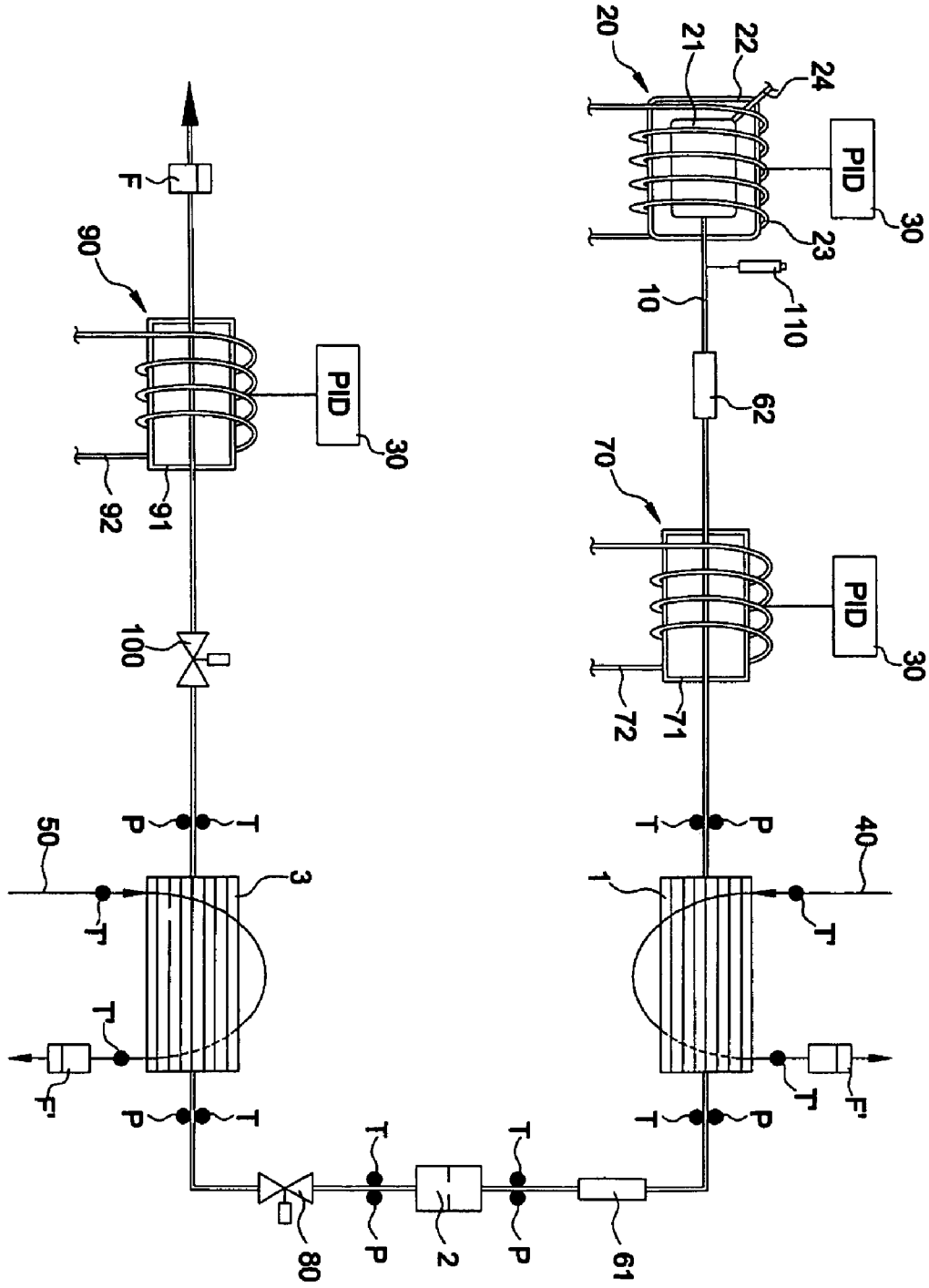
FIG. 1 is a schematic view illustrating an overall structure of a performance testing apparatus of a refrigerating cycle in accordance with a non-limiting, embodiment of present invention.

Now, an exemplary embodiment of the present invention will be described in detail with reference to the annexed drawings.

A performance testing apparatus of a refrigerating cycle in accordance with the present invention serves to test a condenser, an evaporator and an expansion device employed in a refrigerating cycle having a capacity of several watts (w). As shown in FIG. 1, the performance testing apparatus of the present invention is installed such that a condenser 1, an evaporator 3, and a micro orifice 2 serving as the expansion device, have their performances measured. The apparatus comprises a refrigerant pipe 10 provided with open ends. The micro orifice 2, and the evaporator 3 are sequentially aligned from one end of the refrigerant pipe 10 to the other end of the refrigerant pipe 10.

The refrigerant flows in the refrigerant pipe 10 such that the refrigerant sequentially passes through the condenser 1, the micro orifice 2, and the evaporator 3, and has a flow rate less than several grams (g) per minute in consideration of the capacity of the refrigerating cycle substantially applied to the condenser 1, the micro orifice 2 and the evaporator 3. Since the condenser 1, the micro orifice 2 and the evaporator 3 are employed in a small capacity refrigerating cycle, the condenser 1, the micro orifice 2 and the evaporator 3 are designed such that they have proper capacities corresponding to the capacity of the refrigerating cycle. For example, the micro orifice 2 serving as the expansion device has a diameter of several tens of micrometers (μm).

A refrigerant heating unit 20, for heating the refrigerant by a double boiler method so that the refrigerant flows within the refrigerant pipe 10, is installed on an end of the refrigerant pipe 10 at a side of the condenser 1. Since recently developed compressors cannot control the refrigerant having a fine flow rate, the above refrigerant heating unit 20 heats the refrigerant by the double boiler method using water, thereby efficiently controlling the refrigerant having the fine flow rate.

The refrigerant heating unit 20, according to an exemplary embodiment, includes a refrigerant tank 21 connected to one end of the refrigerant pipe 10 for containing the refrigerant therein, a water tank 22 surrounding the refrigerant tank 21 for containing water therein, and an electric heater 23 installed outside of the water tank 22 for heating the water in the water tank 22. When the water tank 22 is heated by the electric heater 23, the water in the water tank 22 reaches a high temperature, thereby heating the refrigerant in the refrigerant tank 21. The refrigerant in the refrigerant tank 21 is transmitted to the refrigerant pipe 10 by pressure generated by the heated refrigerant. Reference numeral 24 denotes an injection port for injecting the refrigerant into the refrigerant tank 21.

The refrigerant heating unit 20 controls the temperature of the refrigerant by means of a general PID controller 30. The PID controller 30 is a temperature regulating apparatus using a proportional plus integral plus derivative (PID) control method, and controls the temperature of the electric heater 23 by means of continuous feedback of the temperature of the refrigerant in the refrigerant tank 21. The PID controller 30 allows the refrigerant in the refrigerant tank 21 to automatically reach a predetermined temperature.

The refrigerant transmitted to the refrigerant pipe 10 through the refrigerant heating unit 20 sequentially passes through the condenser 1, the micro orifice 2 and the evaporator 3, and is then discharged to an outside area through the refrigerant pipe 10 at an opposite side of the refrigerant heating unit 20. Cooling fluids 40 and 50 for exchanging heat with the refrigerant that has passed through the condenser 1 and the evaporator 3 are respectively provided outside of the condenser 1 and the evaporator 3. Accordingly, after the refrigerant flowing within the refrigerant pipe 10 exchanges heat with the cooling fluid 40 in the condenser 1 so that the refrigerant is condensed, the refrigerant passes through the micro orifice 2 so that the refrigerant is expanded, and then exchanges heat with the cooling fluid 50 in the evaporator 3 so that the refrigerant is evaporated. The performances of the condenser 1, the micro orifice 2 and the evaporator 3 are tested by measuring variations in the temperature and pressure of the refrigerant and the flow rate of the refrigerant flowing within the refrigerant pipe 10.

More specifically, a temperature and pressure measurement unit for measuring the variations in the temperature and pressure of the refrigerant passing through the condenser 1, the micro orifice 2 and the evaporator 3 is installed in the refrigerant pipe 10. The temperature and pressure measurement unit includes temperature sensors (T) and pressure sensors (P) installed in the refrigerant pipe 10 at inlets and outlets of the condenser 1, the micro orifice 2 and the evaporator 3. Accordingly, variations in temperature and pressure of the refrigerant passing through the condenser 1, the micro orifice 2 and the evaporator 3 are measured by means of differences of temperatures and pressures between the respective inlets and the outlets of the condenser 1, the micro orifice 2 and the evaporator 3.

In accordance with an exemplary embodiment of the invention, a first cooling fluid 40 passes through an outer surface of the condenser 1 for exchanging heat with the refrigerant in the condenser 1, and a second cooling fluid 50 passes through an outer surface of the evaporator 3 for exchanging heat with the refrigerant in the evaporator 3. The temperature and pressure measurement unit further includes a temperature measurement unit installed at cooling fluid pipes for supplying the first and second cooling fluids 40 and 50. In particular, temperature sensors (T') are provided for measuring the temperatures of the cooling fluids 40 and 50 before and after passing through the condenser 1 and the evaporator 3, and cooling fluid flow meters (F') are provided for measuring the flow rates of the cooling fluids 40 and 50. When variations of the temperature and pressure of the refrigerant that has passed through the condenser 1 and the evaporator 3 are small, the temperature measurement unit (T') and (F') serves to determine the heat exchange amount of the refrigerant by variations in the temperature of the cooling fluids 40 and 50. Further, a flow rate measurement unit including a refrigerant flow meter (F) for measuring the flow rate of the refrigerant flowing within the refrigerant pipe 10 is installed in the refrigerant pipe 10.

Since the micro orifice 2 having a diameter less than several tens of micrometers (μm) is easily clogged, filters 61 and 62 for eliminating impurities from the refrigerant so as to prevent or reduce the clogging of the micro orifice 2 are installed in the refrigerant pipe 10 and are positioned between the refrigerant heating unit 20 and the micro orifice 2.

Filters are provided that include a first filter 61, serving as a main filter, positioned between the condenser 1 and the micro orifice 2 for eliminating or reducing impurities from the refrigerant flowing in front of the micro orifice 2, and a second filter 62, serving as a subsidiary filter, positioned between the refrigerant heating unit 20 and the condenser 1 for eliminating or reducing impurities from the refrigerant prior to the first filter 61.

In accordance with an embodiment of the invention, it is possible to use only one of the first and second filters 61 and 62. The second filter 62 for first eliminating impurities from the refrigerant is designed such that it eliminates impurities having a larger size than those eliminated by the first filter 61. Thereby, impurities contained in the refrigerant can be differently eliminated by the first and second filters 61 and 62 according to the sizes of the impurities.

Since the capacities of the condenser 1 and the evaporator 3 are determined by the capacity of the refrigerating cycle, which is applied to the condenser 1 and the evaporator 3 at an initial design stage, the refrigerants transmitted to the inlets of the condenser 1 and the evaporator 3 should be controlled to have temperatures and pressures suitable to satisfy the requirements at the inlets of the condenser 1 and the evaporator 3 before the refrigerants are respectively introduced into the condenser 1 and the evaporator 3. The variations in the temperatures and pressures of the refrigerant having passed through the condenser 1 and the evaporator 3 are measured based on the above-noted controlled temperatures and pressures serving as standard values.

A first heater 70 is provided for heating the refrigerant by a double boiler method so as to control the temperature and pressure of the refrigerant transmitted to the condenser 1 to satisfy the requirements at the inlet of the condenser 1. The first heater 70 is installed on the refrigerant pipe 10 between the refrigerant heating unit 20 and the condenser 1. A first pressure regulation valve 80 is provided for controlling the temperature and pressure of the refrigerant transmitted to the evaporator 3 to satisfy the requirements at the inlet of the evaporator 3. The first pressure regulation valve 80 is installed on the refrigerant pipe 10 between the micro orifice 2 and the evaporator 3.

The first heater 70 surrounds the refrigerant pipe 10, and includes a water tank 71 for containing water and an electric heater 72, installed outside of the water tank 71, for heating the water tank 71. The first heater 70 thus heats the refrigerant by the double boiler method in the same manner as the refrigerant heating unit 20. The first heater 70 serves to accurately control the temperature and pressure of the refrigerant having a fine flow rate, thereby efficiently satisfying the requirements at the inlet of the condenser 1. The first heater 70 is controlled by a PID controller 30 in a similar manner as is the refrigerant heating unit 20.

Since the micro orifice 2, serving as the expansion device, is a fixed type rather than a variable type, in one embodiment, the first pressure regulation valve 80 installed between the micro orifice 2 and the evaporator 3 serves to control the temperature and pressure of the refrigerant having passed through the micro orifice 2 so as to satisfy the requirements at the inlet of the evaporator 3. The first heater 70 and the first pressure regulation valve 80 respectively satisfy the temperature and pressure requirements at the inlets of the condenser 1 and the evaporator 3, thereby allowing the temperatures and pressures of the refrigerants in the condenser 1 and the evaporator 3 to be simultaneously measured.

In an exemplary embodiment of the present invention, the refrigerant flow meter (F) is installed at the refrigerant pipe 10 at a side opposite the refrigerant heating unit 20 and serves to measure the flow rate of the refrigerant in a gaseous state introduced into the refrigerant pipe 10. In order to allow the flow rate of the refrigerant to be accurately measured by the refrigerant flow meter (F), the temperature and pressure of the refrigerant transmitted to the refrigerant flow meter (F) are set in predetermined ranges according to characteristics of the refrigerant flow meter (F). For this reason, the flow rate measurement unit may further include a second heater 90 and a second pressure regulation valve 100 installed between the refrigerant flow meter (F) and the evaporator 3 for controlling the temperature and pressure of the refrigerant transmitted to the refrigerant flow meter (F) to satisfy the predetermined requirements of the refrigerant flow meter (F). In a similar manner as the first heater 70, the second heater 90 includes a refrigerant tank 91 and an electric heater 92 and heats the refrigerant by the double boiler method. Further, the second heater 90 is controlled by a PID controller 30 in a manner similar to the first heater 70.

A relief valve 110 is installed in the refrigerant pipe 10, and serves to discharge the refrigerant from the refrigerant pipe 10 to an outside area when the pressure of the refrigerant is more than a predetermined value, thus preventing accidents caused by the refrigerant. In particular, the relief valve 110 is installed between the refrigerant heating unit 20 and the first heater 70 so as to discharge the refrigerant to the outside before the refrigerant that has passed through the refrigerant heating unit 20 is re-heated by the first heater 70.

Hereinafter, operation and effects of an exemplary, non-limiting performance testing apparatus of the refrigerating cycle in accordance with the present invention will be described in detail.

The refrigerant is injected into the refrigerant tank 21 of the refrigerant heating unit 20. The condenser 1, the micro orifice 2 and the evaporator 3, are designed based on the capacity of the refrigerating cycle to which they are applied and by which their performances are measured. The refrigerant in the refrigerant tank 21 is supplied to the refrigerant pipe 10 according to the flow rate of the refrigerating cycle applied to the condenser 1, the micro orifice 2 and the evaporator 3.

The refrigerant first passes through the first heater 70, and is transmitted to the condenser 1 so that the temperature and pressure of the refrigerant are controlled to satisfy the requirements at the inlet of the condenser 1. The refrigerant transmitted to the condenser 1 exchanges heat with the first cooling fluid 40 to be condensed, passes through the micro orifice 2 to be expanded, and is then transmitted to the evaporator 3 under the condition that the temperature and pressure of the refrigerant are controlled to satisfy the requirements at the inlet of the evaporator 3 by the first pressure regulation valve 80. The refrigerant transmitted to the evaporator 3 exchanges heat with the second cooling fluid 50 so as to be evaporated. When the refrigerant, having passed through the evaporator 3, passes through the second pressure regulation valve 100 and the second heater 90, the refrigerant is transmitted to the refrigerant flow meter (F) under the condition that the temperature and pressure of the refrigerant are controlled to satisfy the predetermined requirements of the refrigerant flow meter (F). The refrigerant having passed through the refrigerant flow meter (F) is exhausted to the outside from the refrigerant pipe 10.

Here, the respective performances of the condenser 1, the micro orifice 2 and the evaporator 3 are tested by detecting the temperatures and pressures of the refrigerant measured by the temperature sensors (T) and the pressure sensors (P) installed at the inlets and the outlets of the condenser 1, the micro orifice 2 and the evaporator 3, and measuring the flow rate of the refrigerant by the refrigerant flow meter (F). The performances of the condenser 1, the micro orifice 2 and the evaporator 3 are evaluated by comparing the tested performance values to designed performance values of the condenser 1, the micro orifice 2 and the evaporator 3.

Since the impurities contained in the refrigerant transmitted from the condenser 1 are eliminated by the second filter 62 and the first filter 61 when measuring the performances of the condenser 1, the micro orifice 2 and the evaporator 3, it is possible to prevent the micro orifice 2 having a diameter of several tens of micrometers (μm) from being clogged by the impurities contained in the refrigerant. The refrigerant heating unit 20 and the first and second heaters 70 and 90 achieve automatic control of the temperature of the refrigerant, and control the temperature of the refrigerant having a fine flow rate to reach a desired temperature, by means of the PID controller 30.

As is apparent from the above description, the present invention provides a refrigeration-cycle performance testing apparatus, which comprises heating units for heating a refrigerant by a double boiler method and filters for preventing a micro orifice from being clogged, and which thus efficiently tests performances of the micro orifice and a heat exchanger applied to the refrigerating cycle having a capacity of several watts (w).

Although exemplary embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for testing a condenser, an expansion device and an evaporator of a refrigeration cycle, comprising:

a refrigerant pipe disposed such that the condenser, the expansion device and the evaporator are sequentially positioned from one end thereof to the other end thereof;

a refrigerant heating unit installed at one end of the refrigerant pipe which heats a refrigerant and transmits the heated refrigerant to the other end of the refrigerant pipe;

cooling fluids respectively provided outside of the condenser and the evaporator which exchange heat respectively with the refrigerant in the condenser and the evaporator;

a flow rate measurement unit which measures the flow rate of the refrigerant flowing within the refrigerant pipe; and a temperature and pressure measurement unit which measures variations in temperature and pressure of the refrigerant passing through the condenser, the expansion device and the evaporator, wherein the refrigerant heating unit comprises:

a refrigerant tank, connected to an end of the refrigerant pipe, for containing the refrigerant therein;

a water tank, surrounding the refrigerant tank, for containing water therein; and an electric heater, installed outside of the water tank, for heating the water in the water tank.

2. The apparatus for testing according to claim 1, further comprising at least one filter, which reduces impurities in the refrigerant, and which is installed in the refrigerant pipe between the refrigerant heating unit and the expansion device, and wherein the expansion device includes a micro orifice.

3. The apparatus for testing according to claim 2, wherein the at least one filter includes:

a first filter positioned between the condenser and the micro orifice; and a second filter positioned between the refrigerant heating unit and the condenser.

4. The apparatus for testing according to claim 3, wherein the first filter reduces impurities in the refrigerant, and wherein the impurities have a size smaller than the impurities reduced by the second filter.

5. The apparatus for testing according to claim 2, wherein the diameter of the micro orifice is less than several tens of micrometers (μm).

6. The apparatus for testing according to claim 2, wherein the at least one filter reduces impurities in the refrigerant to prevent the micro orifice from being clogged.

7. The apparatus for testing according to claim 1, wherein:

a first heater which heats the refrigerant by a double boiler method so as to control the temperature and pressure of the refrigerant transmitted to the condenser, so as to satisfy predetermined requirements at an inlet of the condenser, is installed on the refrigerant pipe between the refrigerant heating unit and the condenser;

the expansion device includes a micro orifice; and a first pressure regulation valve which controls temperature and pressure of the refrigerant transmitted to the evaporator, so as to satisfy predetermined requirements at an inlet of the evaporator, is installed on the refrigerant pipe between the micro orifice and the evaporator.

8. The apparatus for testing according to claim 7, wherein the first heater includes:

a water tank, surrounding the refrigerant pipe, for containing water; and an electric heater, installed outside of the water tank, which heats the water tank.

9. The apparatus for testing according to claim 7, wherein the first heater controls the temperature of the refrigerant through a PID controller.

10. The apparatus for testing according to claim 7, wherein the flow rate measurement unit includes a refrigerant flow meter installed in the refrigerant pipe at an end of the refrigerant pipe opposite to the refrigerant heating unit; and a second heater and a second pressure regulation valve are installed on the refrigerant pipe between the refrigerant flow meter and the evaporator, which control the temperature and pressure of the refrigerant transmitted to the refrigerant flow meter to satisfy predetermined requirements of the refrigerant flow meter.

11. The apparatus for testing according to claim 10, wherein the second heater comprises:

a water tank, surrounding the refrigerant pipe, for containing water, and;

an electric heater, installed outside of the water tank, which heats the water tank, whereby the second heater heats the refrigerant by the double boiler method.

12. The apparatus for testing according to claim 10, wherein the second heater controls the temperature of the refrigerant through a PID controller.

13. The apparatus for testing according to claim 1, wherein the refrigerant heating unit controls the temperature of the refrigerant through a PID controller.

14. The apparatus for testing according to claim 1, wherein an injection port for injecting the refrigerant into the refrigerant tank is formed through one side of the refrigerant tank.

15. The apparatus for testing according to claim 1, wherein the temperature and pressure measurement unit includes temperature sensors and pressure sensors installed on the refrigerant pipe at inlets and outlets of the condenser, the micro orifice and the evaporator.

16. The apparatus for testing according to claim 15, wherein the temperature and pressure measurement unit further includes a temperature measurement unit which senses variation in temperatures of the cooling fluids.

17. The apparatus for testing according to claim 1, wherein a relief valve is installed in the refrigerant pipe, and serves to discharge the refrigerant from the refrigerant pipe to an outside area when the pressure of the refrigerant is more than a predetermined value.

18. The apparatus for testing according to claim 1, wherein the condenser, the expansion device and the evaporator constitute the refrigerating cycle, which has a capacity of several watts (w).

19. The apparatus for testing according to claim 1, wherein the flow rate of the refrigerant flowing within the refrigerant pipe is less than several grams (g) per minute.

20. The apparatus for testing according to claim 1, wherein the refrigerant heating unit heats the refrigerant by a double boiler method.

21. The apparatus for testing according to claim 1, wherein both ends of the refrigerant pipe are open.

* * * * *